United States Patent [19]

Weaver

[11] Patent Number: 4,995,309

[45] Date of Patent: Feb. 26, 1991

[54] RADON GAS EXHAUST SYSTEM

[75] Inventor: Steven K. Weaver, Carmel, Ind.

[73] Assignee: Radon Control, Inc., Carmel, Ind.

[21] Appl. No.: 470,145

[22] Filed: Jan. 25, 1990

[51] Int. Cl.[5] ..... F24F 7/013

[52] U.S. Cl. ..... 98/42.07; 98/42.02; 285/64

[58] Field of Search ..... 98/1.5, 42.02, 42.07, 98/122, DIG. 10; 110/182; 285/64; 138/116, 117, 155

[56] References Cited

U.S. PATENT DOCUMENTS

| | | | |
|---|---|---|---|
| 1,581,571 | 4/1926 | Frederickson | 285/64 |
| 3,799,703 | 3/1974 | Paine et al. | 98/42.02 X |
| 4,885,984 | 12/1989 | Frahlevs | 98/42.07 |

*Primary Examiner*—Harold Joyce
*Attorney, Agent, or Firm*—Woodard, Emhardt, Naughton Moriarty & McNett

[57] ABSTRACT

An exhaust system for removing radon gas from a building. An electrical fan is mounted exteriorly of the building and is connected to and between a pair of conduits, one of which extends into the building for collection of radon gas, whereas the second tube extends outwardly to allow gas to be exhausted by the fan. A transition box located between the fan and conduit allows for the positioning of the fan apart from the building, whereas the connected conduit is positioned adjacent to blend with the building contour. A housing encloses the fan and conduits.

15 Claims, 3 Drawing Sheets

RADON GAS EXHAUST SYSTEM

BACKGROUND OF THE INVENTION

1. Field of the Invention:

This invention is in the field of exhaust systems for removing radon gas.

2. Description of the Prior Art

Medical evidence has recently emphasized the necessity of removing radon gas from the interior of buildings. The gas found naturally in certain types of soil will seep through cracks in a building foundation or basement wall, eventually accumulating beneath the building. As a result, various systems have been devised for exhausting the gas from the building. The prior exhaust systems typically include an interiorly mounted fan which is operable to exhaust the gas upwardly from the building via a conduit. Such systems occupy not only valuable interior space, but also increase the general noise level as a result of the operation of the fan. I have, therefore, devised a radon gas exhaust system located exteriorly of the building. In order to minimize the exterior visibility of the exhaust system, I have devised a structure to blend the system with the building contours. Such blending has necessitated a placement of the exhaust conduit immediately adjacent or flush with the building exterior wall. As a result, I have devised a new transition box to couple the conduit to the exhaust fan in such a manner to allow the fan outlet to be located apart from the building while the coupled conduit is located adjacent the building.

In certain instances, it is desirable to locate the exhaust system either at ground level or immediately beneath the roof overhang. In view of this requirement, I have designed the exhaust system to be reversible, allowing the system to be located in either location without the necessity of additional components.

SUMMARY OF THE INVENTION

One embodiment of the present invention is a reversible exhaust system for removing radon gas from a building, comprising a base plate mountable exteriorly to the building, a first tube spaced apart from the building, a fan coupled to the first tube, a second tube positionable adjacent the building, a reversible transition box coupling the fan and the second tube, the box mountable to the base plate in one position to extend the second tube upwardly over the transition box and in a second position to extend the second tube downwardly beneath the transition box, and a housing enclosing the reversible transition box and the fan mounted to the base plate.

It is an object of the present invention to provide a new and improved radon gas exhaust system.

A further object of the present invention is to provide a radon gas exhaust system located exteriorly of the building.

In addition, it is an object of the present invention to provide an exteriorly mounted radon gas system design to blend with the building exterior.

A further object of the present invention is to provide a radon gas exhaust system designed to be located either at ground level or immediately beneath the roof overhang.

Other objects and advantages of the present invention will be apparent from the following description.

DESCRIPTION OF THE PREFERRED EMBODIMENTS

Figure 1:
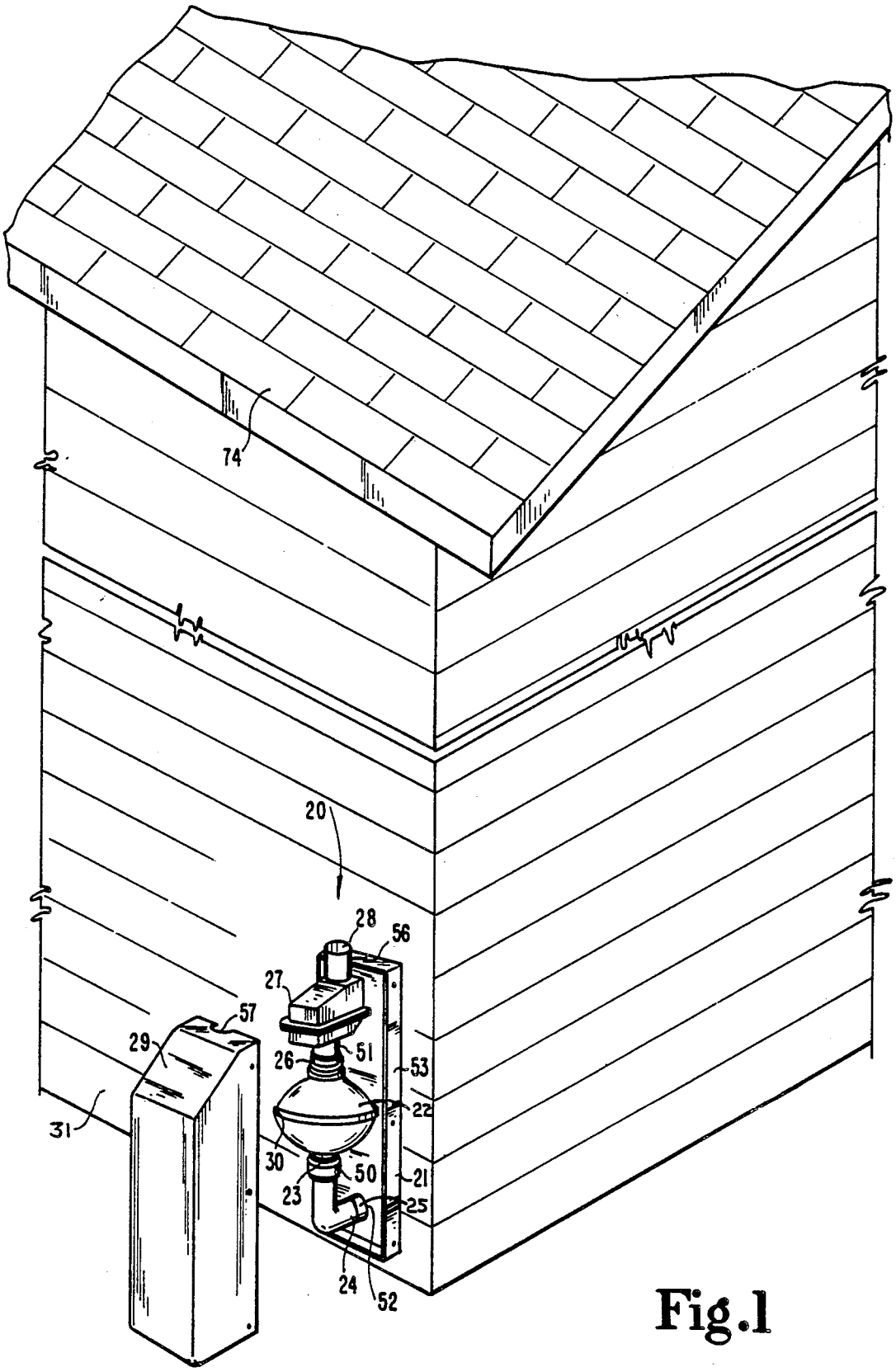
FIG. 1 is a perspective view of the preferred embodiment of the radon gas exhaust system with the outer housing removed.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown the preferred embodiment of a radon gas exhaust system 20 incorporating the present invention. The exhaust system includes a base plate 21 mounted directly to the exterior of the building. A conventional exhaust fan 22 has a downwardly opening inlet 23 coupled to an elbow-shaped conduit 24 in turn coupled to a radon outlet PVC pipe 25, extending through base plate 21 and into the building. An upwardly opening outlet 26 of fan 22 is coupled to a transition box 27 in turn coupled to an upwardly extending conduit 28. A housing 29 is mounted on base plate 21 and encloses fan 22, transition box 27, and coupling 24.

A variety of different types of electrical fans may be utilized. One such fan available for use with the system is commercially available from Fantech, 2555 Industrial Boulevard, Sarasota, Fla. 34234, under Model No. R150 having a 270 cfm capacity. Different capacities may be selected, depending upon the particular application. The fan is electrically connected by a wire extending outwardly through either housing 29 or base plate 21 to a suitable source of electrical energy. One particular feature of such a fan is the approximate vertical alignment of inlet 23 and outlet 26, both of which are spaced radially inward from the most outer portion 30 of the fan. Portion 30 is circular in configuration and extends equidistant around the central vertical axis of the fan. As a result, transition box 27 must be utilized in order to connect outlet 26 spaced apart from base plate 21 with conduit 28 which extends adjacent building exterior wall 31.

Transition box 27 consists of a top half portion 32 and an identical bottom half portion 33. Top half portion 32 will now be described, it being understood that a similar description applies to bottom half portion 33. Top half portion 32 includes a pair of sidewalls 34, 35 integrally joined to a pair of end walls 36, 37 and, in turn, integrally joined to a top wall 38. A downwardly extending, intermediate wall 39 is integrally connected to and extends between top wall 38 and sidewall 37. A hole 40 is formed in top wall 38 and is surrounded by an upwardly extending, cylindrical wall 41. A flange 42 is integrally joined to and extends outwardly from sidewalls 34, 35 and end wall 37. Bottom half portion 33 is identical to top half portion 32 with the exception that bottom half portion 33 is rotated 180 degrees so that cylindrical wall 43 surrounding an aperture extending through bottom wall 64 of the bottom half portion is offset from cylindrical wall 41. Further, the outwardly extending flange 44 of the bottom half portion extends outwardly from the opposite sidewalls and end wall 45, but does not extend outwardly from end wall 46. Conventional fasteners 47 extend through the mating and aligned flanges of the bottom half portion and top half portion, securing the portions together. The top half portion and bottom half portion are each hollow, thereby forming a chamber within the transition box in fluid communication with the pair of apertures surrounded by cylindrical walls 41, 43.

Outlets 23, 26 of fan 22 are cylindrical in configuration and extend outwardly from the housing of the fan. A pair of conventional rubber couplings 50, 51 sealingly secure, respectively, outlet 23 to elbow conduit 24 and cylindrical wall 41 of box 27 to outlet 26. The opposite end of elbow conduit 24 is then sealingly connected to radon outlet PVC pipe 25 which extends through a hole 52 of base plate 21. A circumferentially extending flange 53 extends outwardly from the main wall of the base plate immediately adjacent and inward of the sidewalls and end walls of housing 29. The housing is then secured to flange 53 by means of conventional fastening devices.

Transition box 27 is secured to base plate 21 by means of conventional fastening devices, such as screws, extending through base plate 21 and into wall 36. Conduit 28 extends through recess 57 formed in the top end wall adjacent wall 29 and through a similar recess formed in end wall 56 of base plate 21. Housing 29 is a five-sided box which extends over and encloses the fan and transition box. The top wall of the housing, as viewed in FIG. 1, may be beveled to provide an appearance which blends with the exterior wall of the building.

Figure 2:
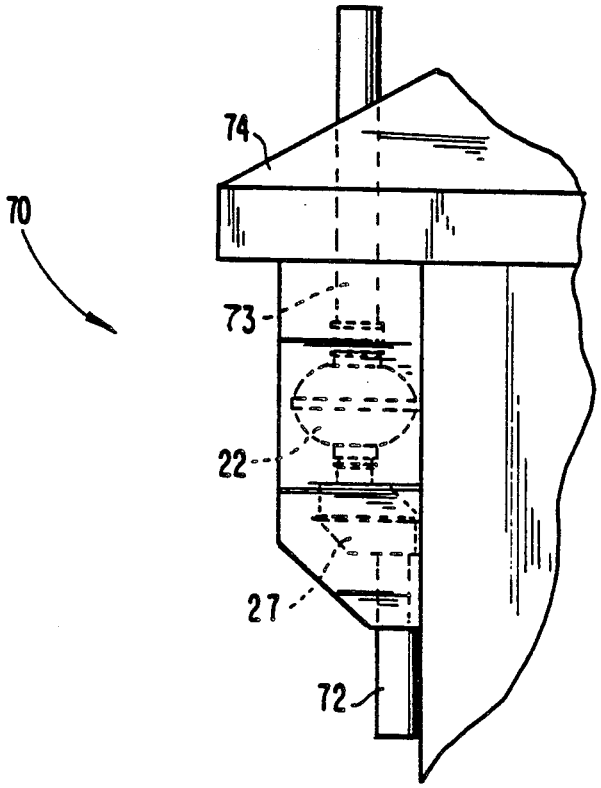
FIG. 2 is a side view of an alternate embodiment of the radon gas exhaust system.
Figure 3:
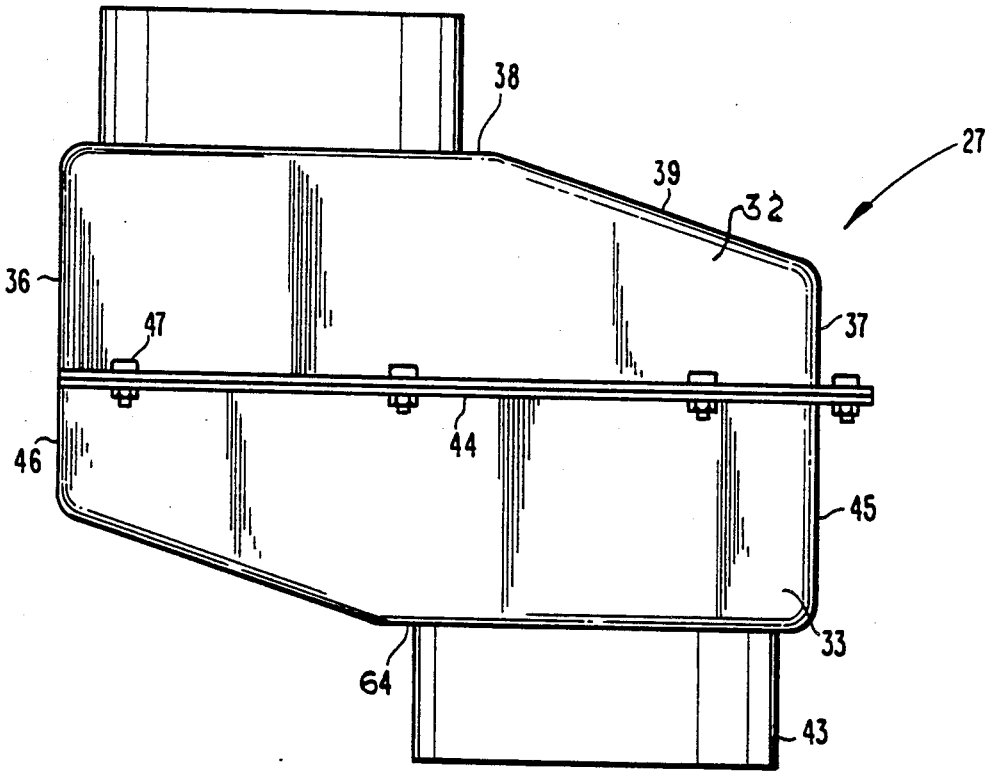
FIG. 3 is an enlarged side view of the transition box used in the exhaust systems of FIGS. 1 and 2.
Figure 4:
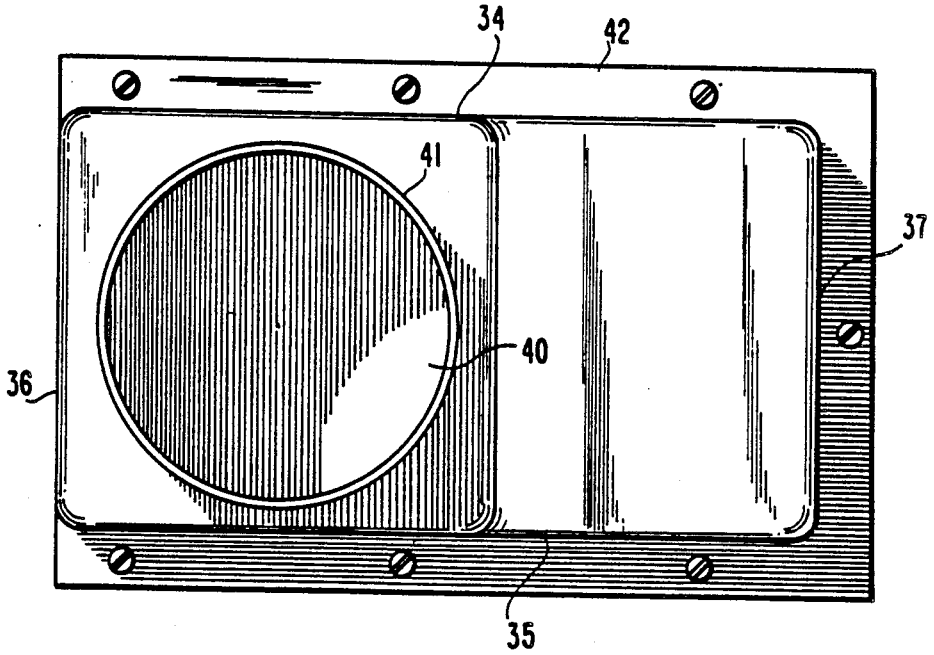
FIG. 4 is a top view of the transition box of FIG. 3.

The alternate embodiment 70 (see FIG. 2) of the radon gas exhaust system, is identical to the embodiment shown in FIG. 1 with the exception that the exhaust system is mounted at an elevated position immediately under the roof overhang 74 in FIG. 2 as compared to ground level in FIG. 1. In view of the alternate positions, all of the components are reversed in position in the embodiment in FIG. 2. In the embodiment depicted in FIG. 1, conduit 24 is spaced outwardly from base plate 21 and building outer wall 31 in order to couple with fan 22 which is beneath box 27. The exhaust conduit 28 leads from box 27 immediately adjacent base plate 21 and the exterior wall of the building. On the other hand, in the embodiment of FIG. 2, fan 22 is located above transition box 27 with the inlet of the transition box being coupled to conduit 72 which then extends downwardly adjacent the base plate and adjacent the sidewall of the building to a location where conduit 72 extends into the building being connected to a radon outlet PVC pipe 25. The outlet of the transition box in FIG. 2 opens upwardly, being connected to the downwardly opening inlet of fan 22. The upwardly opening outlet of the fan is then connected to conduit 73 which extends upwardly, being spaced apart from the base plate and the sidewall of the building. Conduit 73 extends upwardly through the overhang of the roof with the housing and base plate being located immediately adjacent and under overhang 74, whereas the housing and base plate in FIG. 1 are located at ground level, being spaced apart a substantial distance from overhang 74. The beveled end wall of the housing in FIG. 2 faces downwardly, whereas the beveled end wall of the housing in FIG. 1 faces upwardly. In the embodiment of FIG. 2, transition box 27 must be mounted to the base plate in a reverse position as compared to FIG. 1 in order to position the downwardly extending conduit adjacent to the base plate.

While the invention has been illustrated and described in detail in the drawings and foregoing description, the same is to be considered as illustrative and not restrictive in character it being understood that only the preferred embodiments have been shown and described and that all changes and modifications that come within the spirit of the invention are desired to be protected.

What is claimed is:

1. An exhaust system for removing radon gas from a building comprising:

a conduit spaced apart from said building to convey radon gas;

an exhaust fan having an enclosure including an outer portion and further having a first opening and a second opening both being spaced inwardly of said outer portion of said enclosure, said first opening coupled to said conduit;

a transition box having a first passage coupled to said second opening of said fan and further having a second passage;

a tube extending adjacent said building and having an end connected to said second passage, said box defining a chamber in fluid communication with said first passage and said second passage, said first passage being offset from said second passage to position said tube coupled to said second passage adjacent said building while allowing coupling of said fan to said conduit at a location apart from said building; and, a housing enclosing said exhaust fan and said transition box.

2. The exhaust system of claim 1 and further comprising:

a base plate mountable to said building with said housing mounted to said base plate.

3. The exhaust system of claim 2 wherein;

said transition box is mounted to said base plate.

4. The exhaust system of claim 3 wherein:

said housing includes an aperture aligned with said second passage with said tube extending through said aperture to said transition box.

5. The exhaust system of claim 4 wherein:

said tube is extendable into said building to receive radon gas; and, said transition box is positioned beneath said fan with said second passage opening downwardly receiving said tube.

6. The exhaust system of claim 5 wherein:

said housing and base plate are mounted immediately beneath and adjacent the roof of said building.

7. The exhaust system of claim 4 wherein:

said conduit is extendable into said building to receive radon gas; and, said transition box is positioned above said fan with said second passage opening upwardly receiving said tube.

8. The exhaust system of claim 7 wherein:

said housing and base plate are mounted at ground level.

9. A reversible exhaust system for removing radon gas from a building comprising:

a base plate mountable exteriorly to said building;

a first tube spaced apart from said building;

a fan coupled to said first tube;

a second tube positionable adjacent said building;

a reversible transition box coupling said fan and said second tube, said box mountable to said base plate in one position to extend said second tube upwardly over said transition box and in an second position to extend said second tube downwardly beneath said transition box; and, a housing enclosing said reversible transition box and said fan mounted to said base plate.

10. The exhaust system of claim 9 wherein:

said transition box includes a chamber with a first outwardly opening passage and a second outwardly opening passage, said first passage and said second passage in fluid communication together but being offset to position said second tube coupled to said second passage adjacent said building while allowing coupling of said fan to said first passage at a location apart from said building.

11. The exhaust system of claim 10 wherein:

said housing has an end wall and said base plate has a flange positioned adjacent said end wall, said end wall forms a hole through which said second tube extends.

12. The exhaust system of claim 11 wherein:

said second tube extends into said building to receive radon gas; and, said transition box is positioned beneath said fan with said second passage opening downwardly receiving said second tube.

13. The exhaust system of claim 12 wherein:

said housing and base plate are mounted immediately beneath and adjacent the roof of said building.

14. The exhaust system of claim 11 wherein:

said first tube is extendable into said building to receive radon gas; and, said transition box is positioned above said fan with said second passage opening upwardly receiving said second tube.

15. The exhaust system of claim 14 wherein:

said housing and base plate are mounted at ground level.

* * * * *